United States Patent [19]

Cerny et al.

[11] 3,937,142

[45] Feb. 10, 1976

[54] SHEET TRANSFER APPARATUS

[75] Inventors: Arnost Cerny, Blansko; Jiri Svoboda, Svitavka, both of Czechoslovakia

[73] Assignee: Adamovske strojirny, narodni podnik, Adamov, Czechoslovakia

[22] Filed: May 10, 1973

[21] Appl. No.: 359,183

[30] Foreign Application Priority Data

May 15, 1972 Czechoslovakia ..... 3254-72

[52] U.S. Cl. ..... 101/409; 101/232

[51] Int. Cl.[2] ..... B41F 21/04

[58] Field of Search ..... 101/409–411, 101/232

[56] References Cited

UNITED STATES PATENTS

| | | | |
|---|---|---|---|
| 1,285,774 | 11/1918 | Middleditch | 101/410 |
| 2,757,610 | 8/1956 | Gegenheimer et al. | 101/183 |
| 2,767,653 | 10/1956 | Babicz | 101/409 |
| 3,096,088 | 7/1963 | Young | 101/409 |
| 3,385,597 | 5/1968 | Gnzik | 271/82 |
| 3,430,946 | 3/1969 | Siebke | 271/51 |
| 3,455,547 | 7/1969 | Rudolph et al. | 271/82 |
| 3,463,484 | 8/1969 | Rudolph | 101/409 |
| 3,537,391 | 11/1970 | Mowery | 101/230 |
| 3,654,861 | 4/1972 | Rudolph et al. | 101/183 |

FOREIGN PATENTS OR APPLICATIONS

| | | | |
|---|---|---|---|
| 179,637 | 5/1922 | United Kingdom | 101/409 |

*Primary Examiner*—Edgar S. Burr
*Assistant Examiner*—William Pieprz

[57] ABSTRACT

Apparatus for seizing and holding the trailing edge of a paper sheet for transfer and turn-over in a printing press. The sheet transfer cylinder is provided with a rotatable central shaft and a plurality of segment members arranged in spaced planes radial to the shaft in at least one set to provide a cylindrical circumferential surface for the paper. The apparatus comprises a first elongated rod extending through the segments of the set and journalled for rotation about its longitudinal axis, brackets fixed to the rod and extending toward the circumferential surface, and a second elongated rod journalled in the brackets for rotation about its longitudinal axis exterior of the segments. Gripper elements are carried by the second rod, and a counter-ledge or bar is carried by the brackets. The gripper elements are adapted to cooperate by mechanical action with the bar to seize the paper sheet on movement of the second rod.

4 Claims, 2 Drawing Figures

2
2
A
1
3
4
14
16
18
19
20
21
23
25
26
27
28
29
30
32
32a
33
34
35
36
37
38
39
42
43
44
45
46
47
48
49
57
S

SHEET TRANSFER APPARATUS

BACKGROUND OF THE INVENTION

The present invention relates to sheet transfer apparatus for multipress printing machines and in particular to apparatus for seizing the edge of the paper sheet on a rotatating transfer cylinder in order to turn the sheet over.

Multiprint printing machines such as multicolor presses require that the sheet be transferred between successive printing units to be impressed sequentially with different color and overlays and the like.

A transfer cylinder is employed to transfer the paper sheet from the first printing unit to the following printing unit. In practice it is often necessary to also print with several colors on both sides of the sheet during a single pass through the machine. In order to print a paper sheet on two sides it is necessary to turn the sheet while it is being transferred by the transfer cylinder to the adjacent print or intermediate transfer cylinders of the following printing unit. There are known sheet transfer cylinder whose diameters are made double the diameter of the adjacent cylinders. These transfer cylinders are provided with mechanical grippers which seize the leading edge of the paper sheet and hold the trailing edge of the sheet by a suction mechanism while turning the sheet. These suction devices effect the holding of the trailing edge of the sheet on the outer circumference of the transfer cylinder and are adjustably arranged at a given distance from the mechanical grippers which seize the leading edge of the paper sheet. This distance is adjustable according to the size of the paper sheet to be transferred.

A disadvantage of the above described device is in that the air distribution for the suction means is complicated, and as a result does not achieve a good printing register.

It has been attempted to provide sheet transfer cylinders which have suction devices for holding the trailing edge of the paper sheet with an air distributing system comprising special vacuum pressure tubing, a nozzle, a shaft and a carrying arm. The displacement and the adjustment of the suction devices on the circumference of the sheet transfer cylinder is made possible by means of a cam segment and a lever, on which electrically controlled means are arranged for turning of the carrying arm in the opposite directions. A disadvantage of this mechanism is in that the combined means is rather complicated and expensive in production, since there are two power sources; a vacuum air supplying the suction device and an electric source, connected to the carrying mechanism.

All hitherto known devices for holding the trailing edge of a paper sheet on the circumference of the sheet transfer cylinder employ the principle of vacuum suction devices. They must therefore be equipped with special vacuum supply sources and with driving units which increase the expense of the producer as well as of the printer.

It is an object of the present invention to provide apparatus for seizing and holding the trailing edge of the paper sheet on a transfer cylinder which overcomes the above noted disadvantages.

It is a further object of the present invention to provide apparatus for seizing and holding the trailing edges of the paper sheet on a transfer cylinder which is mechanical in nature and eliminates both suction devices and electrical controls.

It is a further object of the present invention to provide an improved simplified and inexpensive means for securing and holding paper sheets on a turning transfer cylinder.

These and other objects as well as numerous advantages are set forth in the following disclosure.

SUMMARY OF THE INVENTION

According to the present invention, apparatus for seizing and holding the trailing edge of a paper sheet for transfer and turn-over in a printing press is provided for a sheet transfer cylinder having a rotatable central shaft and a plurality of segment members arranged in spaced planes radial to the shaft in at least one set to provide a cylindrical circumferential surface for the paper. The apparatus comprises a first elongated rod extending through the segments of the set and journalled for rotation about its longitudinal axis, brackets fixed to the rod and extending toward the circumferential surface, and a second elongated rod journalled in the brackets for rotation about its longitudinal axis exterior of the segments. Gripper elements are carried by the second rod, and a counter-ledge or bar is carried by the brackets. The gripper elements are adapted to cooperate with the bar to seize the paper sheet on movement of the second rod.

Preferably the segments are arranged in two sets, arranged diametrically opposite to each other. At least some of the segments of each set are arranged on a first tube and the other of the segments of each set on another tube. The tubes are axially secured over the shaft for conjoint rotation, so that the cylinder and mechanism may be easily assembled.

The segments and brackets arranged at one end of the thus formed cylinder, act as a control member. At one end of the control bracket there is mounted a pivotal cam follower which cooperates with an inner eccentric guide way of cam which is fixed to a side wall of the printing machine, and an abutment surface, which abuts against an abutment which is formed by an adjustable screw fixed on the adjacent control segment. On one end of the carrier rod is fixed a two armed lever, on one arm of which is mounted a cam follower roller which follows a second inner guide way of the cam, and on the other arm of which there is first arranged a rotably adjustable eccentric regulating pin and second a pivot pin on which is mounted a pull rod the side portion of which seats on the eccentric regulating pivot. The pull rod is attached at its free end to one end of a spring, the other end of which is hinged on the pivot shaft of the cam follower roller.

As will be seen, the advantages of the mechanism according to the invention are in its simple arrangement, whereby maximum accuracy is obtained while transfer of the paper sheets from one printing unit to the cylinders of the following printing unit. In comparison to hitherto known devices of this kind the air distributing piping and underpressure supplying compressor with drive are not necessary.

The mechanism in practice also enables considerable saving of electric energy.

Full details of the present invention follow in the subsequent description and are set forth in the accompanying drawings.

DESCRIPTION OF THE INVENTION

Figure 1:
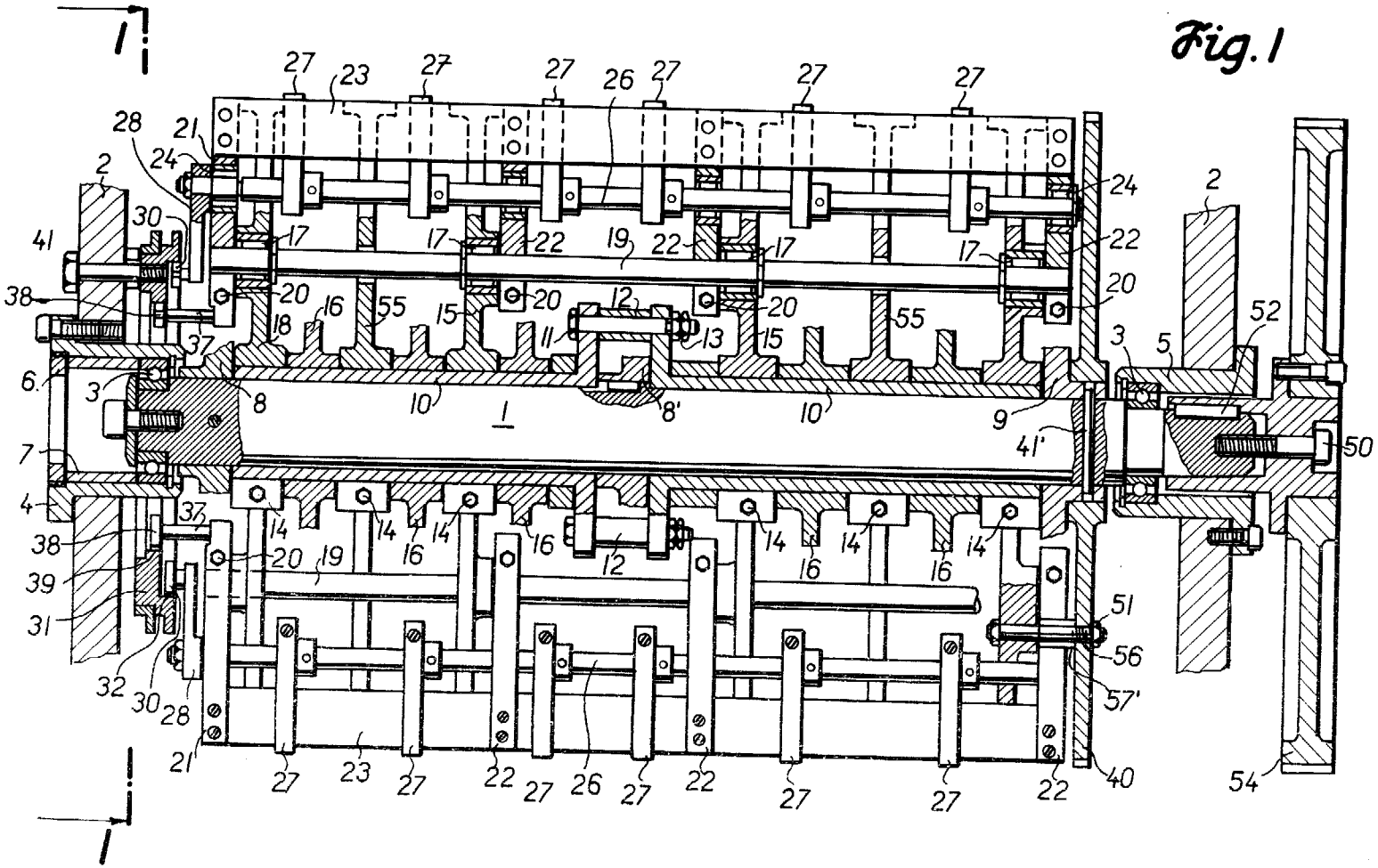
FIG. 1 is a view of a sheet transfer cylinder, partially sectioned along the plane 2 — 2 of FIG. 2.

The apparatus for seizing and holding the trailing edge of a paper sheet 57 according to the invention comprises a sheet transfer drum or cylinder formed of a shaft 1 rotatably mounted between vertical side walls 2 in bearings 3 which are located in bushes 4, 5. The right bushing 3 comprises a flanged sleeve adapted to fit through a hole in the side wall having a spring clip or c-ring retainer holding the bearing 3. The left bushing 4 is similar but is provided with a spacer tube 7 and an internal nut 6 by which the bearing 3 is secured against axial play. At the left end of the shaft 1, there are fixed radially extending carrier arms 8, and in the axially middle of the shaft carrier arms 8'. On the other end of the shaft 1 is fixed a carrier arm 9. The carrier arms 8, 8' and 9 serve for the mounting of not illustrated gripper means for the seizing of the leading edge of the sheet 57. The gripper means for the leading edge of the sheet is conventional in this art, and requires no further explanation here.

Figure 2:
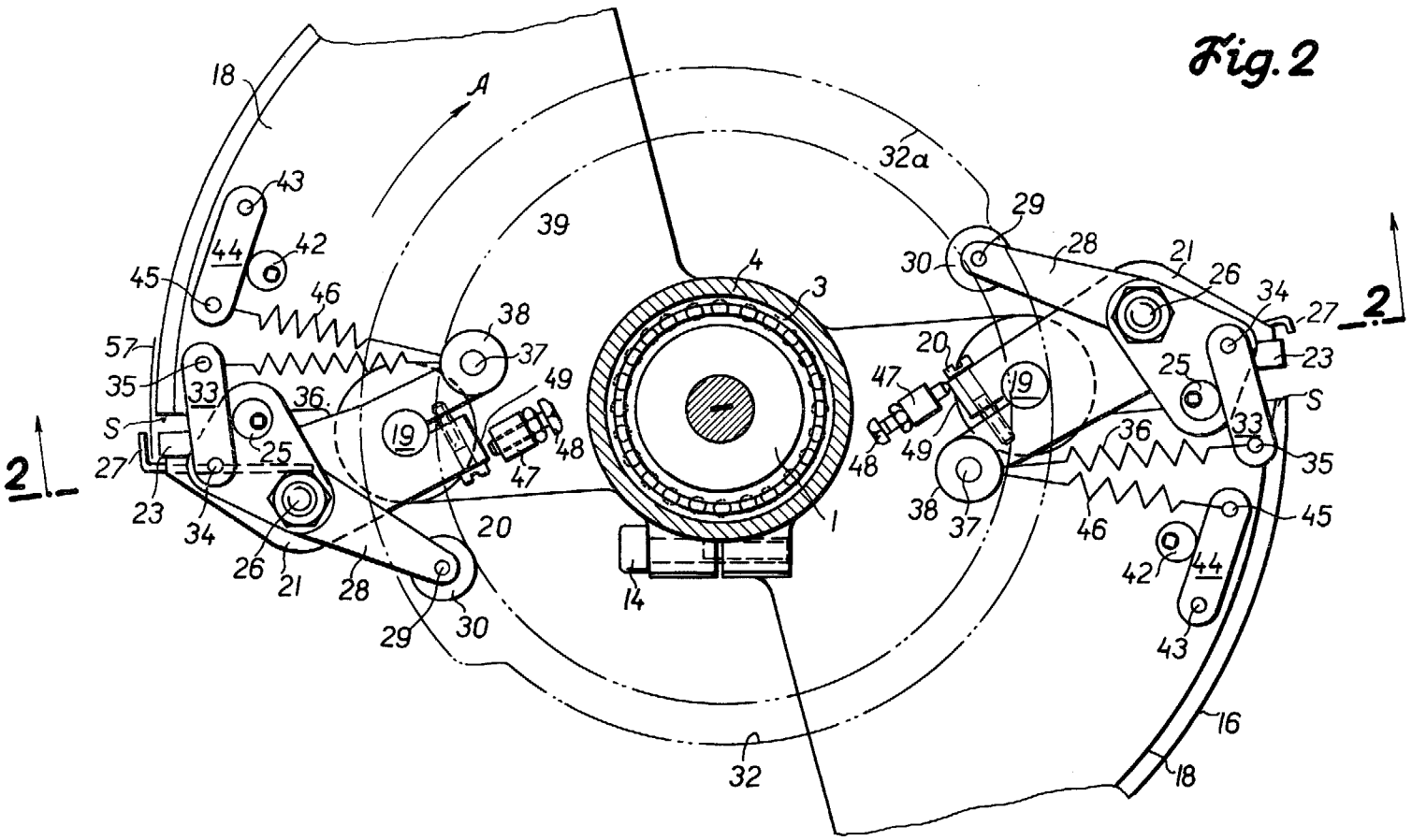
FIG. 2 is a section along the plane 1 — 1 of FIG. 1, illustrating the cam in dot-dash lines and omitting the carrier arm.

Mounted on the shaft 1 are two tubes 10 which are connected by means of bolts 11, spacers 12, and nuts 13 to be axially spaced from each other. On each of the tubes 10, there are fixedly mounted by screws 14 two sets of segment bodies 15 and alternating therewith supporting segments 55. Alternating with the segments 15 and 55 are segment bodies 16 rotatable about the tubes 10. At the left end of tube 10 a control segment body 18 of slightly smaller diameter is provided which is fixed by screw 14. The segments 15 and 16 are divided into two symmetrical sets, as seen in FIG. 2, to form cooperating segments axially across the shaft having arcuate circumferential surfaces lying coextensive with each other to thus form the cylinder or cylindrical surface on which the sheet 57 lies. Each such surface is diametrically opposite the other. The side edges of the segments provide open segmented portions, the space of which may be varied by adjustment of the rotatable segments 16. The gripper mechanism for the leading edge of the paper (not shown) is adapted to extend outwardly and along the axially extending edge of the segments in the portion broken away in FIG. 2, and constitutes the leading edge of the cylinder segments taken in the direction of rotation illustrated by the arrow A, (FIG. 2).

Mounted in bearings 17 in each of the sets of segment bodies 15 and the control segment 18 are axially aligned rods 19, which pass through openings provided in the supporting segments 55. On each of the rods 19, there are fixed by means of screws 20, a bracket 21 and several brackets 22 the left one of which, bracket 21, constituting the control bracket. The brackets 21 and 22 extend parallel to each other chordally to the longitudinal axis, outside of the trailing edge S of the cylinder to have their ends lie in the space between segment sets. On the outer end of each set of control brackets 21 and 22 is fixed a bar 23 forming a rear ledge which extends outwardly of the cylinder along its entire length and substantially radially coextensive with the peripheral surface edges of the segments. In the control brackets 21 and in the brackets 22, bearings 24 journal a supporting rotatable rod 26 which fixedly carries a plurality of gripper means 27 adapted to cooperate with the bar 23 to seize the trailing edge of the paper sheet 57. The gripper means 27 have shaped end portions similar to fingers which seat on the rear bar 23.

The carrier rod 26, is provided with a two armed lever 28 fixed at the left end. A pivot pin 29, on which is mounted a roller 30 is provided at the end of one of the arms of lever 28. A cam plate 31 is fixed on the side wall 2 of the printing machine by means of screws 41. The cam 31 is formed with a contoured circular inner guide way 32 having a portion 32a of larger diameter over about half of its circumference. A second inner guide way 39 eccentric with the axis of the shaft 1 is set within the guide way 32. The follower 30 bears against the inner guide way 32. On the inner end of the bracket 21 there is provided an axle pin 37, on which is mounted a follower roller 38 which is received in and bears on the inner eccentric guide way 39 of the cam 31. The two armed lever 28 has on its opposite end an enlarged lug, in which an eccentrically rotatable regulating pivot pin 25 is fixed. The pivot pin 25 may be rotatable about a fixed axis and have a circumference eccentric to it, or it may be fixed on an eccentrically shaped axis and having a circular circumference. In any event rotation of pin 25 causes its surface edge to be laterally displaced. A pivot axle 34 is also mounted on the lug end and pivotally carries a pull rod 33, which extends outwardly so that its side passes the eccentric pin 25 and is at its other end provided with a pin 35, on which is attached one end of a spring 36. The second end of the spring 36 is hinged on the axle pin 37 of the cam follower roller 38. The pull rod 33 is urged by means of the spring 36 against the eccentric regulating pivot 25. An eccentric regulating pivot 42 (similar to pivot 25) is mounted on the said face of control segment 18. A pull rod 44 which is swingably attached with one end on a pivot 43 is urged to bear against the eccentric pin 42 by a spring 46 fixed at one end by a pin 45 and its other end also attached on the pivot 37 of the cam follower roller 38. In each of the oppositely arranged control segments 18 there is fixed an abutment 47 which is provided with an adjustable stop screw 48. When the gripper means 27 is opened, the bracket 21 abuts the stop screw 48 and is therefore provided with an abutment surface 49 provided on the end portion of the bracket 21 behind the cam follower roller 38.

The carrier arm 9 which has an axial sleeve is provided with a gear 40 attached to it by a transverse pin 41 which is rigidly connected by means of a bolt 56 which passes through an enlarged hole 57 and a nut 51 to the rightmost one of the segment bodies 15. In this manner the carrier arms 8, 8' and 9 on which the gripping means of the leading edge are mounted can be angularly adjusted with the segments 15, 18 and 55 on which the gripping means for the trailing edge is mounted. Since as will be obvious the segments 15, 55 etc., mounted on tubes 10 are rotatable relative to the carrier arms 8, 8' and 9 at least within the dimensions of hole 57. On the same end of the shaft 1 there is fixed by means of a key 52 and a screw 50 an insert hub which is provided with a gear 54, by which the shaft 1 may be rotated by a drive transmission linked to the machine drive. The cylinder is thus driven via the gear 54 and gear 40 which move the two portions in relative fixed relationship, depending on the initial arrangement of the gear 40 relative to gear 54.

From the foregoing it will be seen that a sheet transfer and turning cylinder is provided having segmented flat circular sections, arranged parallel to each other radiating outwardly from the central shaft to form a peripheral surface on which a sheet may lie. The cylinder is such that conventional gripping mechanisms can be used at the leading edge of the segment sets, which operate in conventional manner, and is such that the cylinder may as a whole be employed in conventional presses, to turn over and transfer the sheet from one printing unit to another. Consequently, a detailed discussion and/or a showing of the conventional mode of gripping the leading edge, turning the sheet or transferring the sheet from unit to unit is omitted here for the sake of brevity. These items will be obvious to those skilled in the art.

The gripping means comprises basically the ledge or bar 23 and the cooperating grippers 27. The bar 23 is joined to the brackets 21 and 22 and is movable with them under actuation of the rotatable rod 19 so that the ledge 23 is carried toward and away from the trailing edge of the set of segments 15, 16 and 18. The grippers 27, on the other hand are mounted on a second rod which is pivotally journalled on the brackets 21 and 22 so as to be conjointly carried along with the bar 23 as well as being pivoted with respect to it as like a scissors. The cams 32 and 39 are respectively adapted to sequentially close the grippers 27 on the bar 23 and then carry the closed bar 23 and the grippers together away from and then back to the edge S. The spring 46 is adapted to urge the roller 38 into engagement with cam 39 while the spring 36 urges roller 30 into engagement with cam 32. The assembly of eccentric pins 25 and pull rod 33 and eccentric pin 42 and pull rod 44 permits adjustment of the spring tension and traverse of the respective grippers 27 and bar 23. The abutment means 48 limits the span over which the paper is stretched by movement of bracket 21.

It will be also noted that the segmented sets are symmentrically arranged with each other and similarly constructed so that the "cylinder" is capable of seizing and holding two sheets of paper simultaneously. The cam plate 31 may be a single member having a pair of internal cam surfaces or it may be formed of two members arranged one inside the other.

The described mechanism operates as follows:

The rotation of the shaft 1 in the forward direction shown by arrow A is obtained via driving gears 54 from a not illustrated but conventional drive mechanism. When the shaft 1 of the sheet transfer cylinder rotates, the cam follower roller 30 of the two armed lever 28 is urged by the effect of the spring 36 onto the inner guide way 32 of the cam 31. As a result of the movement of the follower roller 30 on the inner guide way 32 of the cam 31 into the larger diameter portion 32a, as seen in FIG. 2, left segment set, the two armed lever 28 is pivoted and the carrier rod 26 is caused to turn clockwise under action of the spring 36 so that the gripper means 27 abuts the bar 23 to seize the trailing edge of the paper sheet 57. As soon as the trailing edge of the sheet 57 is seized by the gripper means 27, the follower roller 30 stops its radial movement but is held in the gripping position by the pull of the spring 36. The follower 38 of the holder 21 continues, however, to follow the inner eccentric guide way 39 of the cam 31, so that the rear ledge 23 and the gripper means 27 begin to be removed from the rear edge S of the control segment 18 from the segments 15 and the supporting segment bodies 55. This causes the paper sheet 57 to span tightly across the surface of the segments 15, 16 and 55 by pulling the trailing end. Of course the leading end has already been grasped and held tightly by its gripper means. In this condition the sheet 57 can be carried around by the cylinder until it is turned and transferred to the next printing unit in the usual manner. Thereafter, the paper may be grasped at the next print unit or intermediate cylinder at which time the roller 29 hits the smaller diameter portion of the cam 32 thus opening the grippers 27 as in the right segment set (FIG. 2). It is noted that the eccentricity of the cam 39 is such that the pivoting of bracket 21 is greater at the left quadrant of FIG. 2 than at the lower right quadrant.

Adjustment of the mechanism to accommodate varying lengths of paper, is easily made by regulation of screw 48 which limits the backward movement of the bar 23 from the trailing edge S. As a result the present apparatus has universal application.

It will be seen from the foregoing that simple mechanism has been obtained to provide for sheet transfer and turn-over, eliminating the need for pneumatic or electrical sources to operate the suction devices. Constant replacement of parts is eliminated and the need to change parts to accommodate different size papers is also eliminated. The mechanism is simple and inexpensive.

Various modifications, changes, etc., will be obvious to thos skilled in this art. It is intended therefore, that the present disclosure be illustrative only and notlimiting of the invention.

What is claimed:

1. In a sheet transfer device for a printing press having a pair of frame sides, and a cylinder comprising a rotatable shaft journalled within said frame sides, and, a plurality of segment members fixed to said shaft, said segment members being spaced axially of each other and arranged in a pair of sets to have a common peripheral surface and leading and trailing edges, each of said segment sets having mechanical gripper means mounted for seizing the leading edge of said sheet, and apparatus for seizing the trailing edge of said sheet comprising, a first rod axially extending through the segments of said cylinder and journalled for rotation about its longitudinal axis, brackets fixed to said rod and extending outwardly adjacent the trailing edge of said peripheral surface, a second axially extending rod journalled within said brackets exterior of the segments of said cylinder to rotate about its longitudinal axis, gripper elements carried by said second rod, a bar mounted at the end of said brackets forming a ledge adapted to cooperate with said gripper elements, means for rotating said second rod to cause said gripper elements to seize the trailing edge of a paper sheet and means for rotating said first rod comprising an eccentric circular cam mounted on one of said sides, a first cam follower mounted on the one bracket adjacent said one side and engaging said cam to thereby cause said one bracket to pivot said first rod, an eccentric pin mounted on said cylinder adjacent said one bracket, a pull rod pivotally mounted on said cylinder adjacent said pin, and spring means connecting said pull rod and said first cam follower to adjustably urge said first cam follower against the first cam, said means being operable during the seizing of the leading edge of the sheet to move said brackets away from the adjacent trailing edge of said peripheral surface to thereby stretch said sheet over the peripheral surface of said segment set.

2. The apparatus according to claim 1 wherein the segments of one set of segments arranged diametrically opposite to the segments of the other set, the segments of each set alternating axially with the segments of the other set, said segments said segments being divided and fixed in part on a first tube and in part on a second tube, said first and second tubes being secured in spaced relation over said shaft for conjoint rotation therewith.

3. The apparatus according to claim 1 including adjustable stop means mounted on the segment adjacent said one bracket to engage said one bracket and limit the rearward movement thereof.

4. The apparatus according to claim 1 including a second circular cam mounted on said one side frame adjacent said one bracket, a two armed lever mounted at the end of said second rod adjacent said one side frame, a second cam follower mounted at the end of one arm of said lever and engaging said second circular cam, the other arm having on the one hand a rotatable pivot pin eccentrically mounted thereto and on the other hand a fixed pivot pin, a pull rod attached on one end to said fixed pivot pin and the other end to a spring urging the pull rod against the eccentrically mounted rotatable pin, said spring being secured to said end of said one bracket adjacent said second cam follower.

* * * * *